United States Patent [19]

Stepe

[11] 4,006,544

[45] Feb. 8, 1977

[54] REPLACEABLE CUTTING EDGE ASSEMBLY

[75] Inventor: Visvaldis A. Stepe, Willow Springs, Ill.

[73] Assignee: Caterpillar Tractor Co., Peoria, Ill.

[22] Filed: May 12, 1975

[21] Appl. No.: 576,780

[52] U.S. Cl. ..... 37/141 T; 37/142 R; 172/719; 172/749; 172/753; 172/777

[51] Int. Cl.² ..... E02F 9/28

[58] Field of Search ..... 37/141 R, 141 T, 142 R, 37/142 A, 135; 172/767, 777, 749–751, 719, 698, 753; 299/88; 214/145

[56] References Cited

UNITED STATES PATENTS

| | | | |
|---|---|---|---|
| 1,533,781 | 4/1925 | Yocum | 37/142 |
| 1,668,166 | 5/1928 | McKee et al. | 37/135 |
| 1,745,436 | 2/1930 | Miley | 214/145 |
| 2,824,392 | 2/1958 | Reinhard | 37/141 T |
| 3,006,089 | 10/1961 | Johnson | 172/753 X |
| 3,113,390 | 12/1963 | Pewthers | 37/142 R |
| 3,243,906 | 4/1966 | Washbond | 214/145 X |
| 3,497,973 | 3/1970 | Campbell | 37/141 R |
| 3,621,594 | 11/1971 | Hahn et al. | 37/141 R |
| 3,762,079 | 10/1973 | Lukavich et al. | 37/141 R |
| 3,851,413 | 12/1974 | Lukavich | 37/141 T |

FOREIGN PATENTS OR APPLICATIONS

| | | | |
|---|---|---|---|
| 791,578 | 8/1968 | Canada | 37/141 R |
| 1,292,612 | 10/1972 | United Kingdom | 37/142 R |

*Primary Examiner*—Edgar S. Burr
*Assistant Examiner*—Steven A. Bratlie
*Attorney, Agent, or Firm*—Phillips, Moore, Weissenberger, Lempio & Majestic

[57] ABSTRACT

Two embodiments of a replaceable cutting edge assembly for earthmoving buckets, each assembly including a plurality of cutting edge sections arranged along a leading edge of the earthmoving bucket floor with digging teeth overlapping the junctures between the cutting edge sections, the cutting edge sections being configured for attachment to the bucket floor, for example, by means of bolts, while trapping and holding the digging teeth in place in order to facilitate replacement of individual portions of the assembly while also adapting the bucket for use with a single elongated cutting edge without the digging teeth. In one embodiment, the cutting edge sections and teeth are designed to provide a flush bottom surface suitable for finish work even with the teeth in place. In the second embodiment, additional means are employed to secure both the digging teeth and cutting edge sections in place along the leading edge of the bucket floor.

8 Claims, 7 Drawing Figures

REPLACEABLE CUTTING EDGE ASSEMBLY

BACKGROUND OF THE INVENTION

The present invention relates to a replaceable cutting edge assembly and more particularly to such an assembly having a replaceable cutting edge arranged along the entire leading edge of an earthmoving bucket, for example, together with spaced apart digging teeth.

Cutting edges of the type contemplated by the present invention are employed in a variety of earthmoving implements such as buckets, front end loaders and backhoes, for example. Such implements are generally characterized by a bucket or bowl-like member configured to receive earth and the like, the bucket or bowl including a floor with a leading edge over which material is introduced into the bucket.

Such earthmoving implements are further characterized by operation wherein the forward edge of the bucket is urged into penetrating engagement with the ground with material passing over the leading edge being retained within the bucket.

The leading edge of the bucket is commonly equipped with a cutting edge along its length and spaced apart digging teeth to facilitate earthmoving operations. During such operations, very substantial wear is experienced by the cutting edge and digging teeth so that it is common practice to make those elements readily replaceable. For example, separate cutting edge sections and digging teeth may be replaced as necessary. In addition, those elements may also be formed from wear-resistant materials to further facilitate earthmoving operations and to resist wear, thereby permitting a longer operating life for the cutting edge assembly.

The use of digging teeth within the cutting edge assembly greatly facilitates operation of the bucket, particularly where substantial quantities of earth, rocks and the like are to be loaded into the bucket. However, buckets or implements of the type contemplated by the present invention are also commonly employed for finishing operations where the cutting edge of the bucket may be employed to leave a smooth surface upon the ground. The digging teeth often interfere with such finishing operations. Accordingly, it is often necessary to adapt the earthmoving bowl for operation having a cutting edge along its entire leading edge together with spaced apart digging teeth as well as with an elongated cutting edge alone.

SUMMARY OF THE INVENTION

Accordingly, it is an object of the present invention to provide a cutting edge assembly of relatively simple and rugged construction wherein a plurality of cutting edge sections may be arranged along the leading edge of a bucket floor either with or without spaced apart teeth to facilitate digging operations.

It is a more particular and specific object of the invention to provide such a cutting edge assembly wherein a plurality of cutting edge sections may be secured to the leading edge of the bucket, for example, by means of bolts, while trapping the spaced apart teeth in place, a single elongated cutting edge also being attachable to the leading edge of the bucket without the spaced apart digging teeth while using the same bolt holes employed for the plurality of cutting edge sections.

It is a further object of the invention to provide a replaceable cutting edge assembly of the type initially referred to above wherein the pluraltiy of cutting edge sections and the digging teeth form a common, flush bottom surface to permit at least limited finishing operations even with the digging teeth in place.

It is also an object of the invention to provide a replaceable cutting edge assembly of the type initially referred to above wherein additional means are employed to secure both the digging teeth and the cutting edge sections in place upon the forward edge of the bucket floor.

Additional objects and advantages of the invention are made apparent below having reference to the accompanying drawings.

DESCRIPTION OF THE PREFERRED EMBODIMENT

Figure 1:
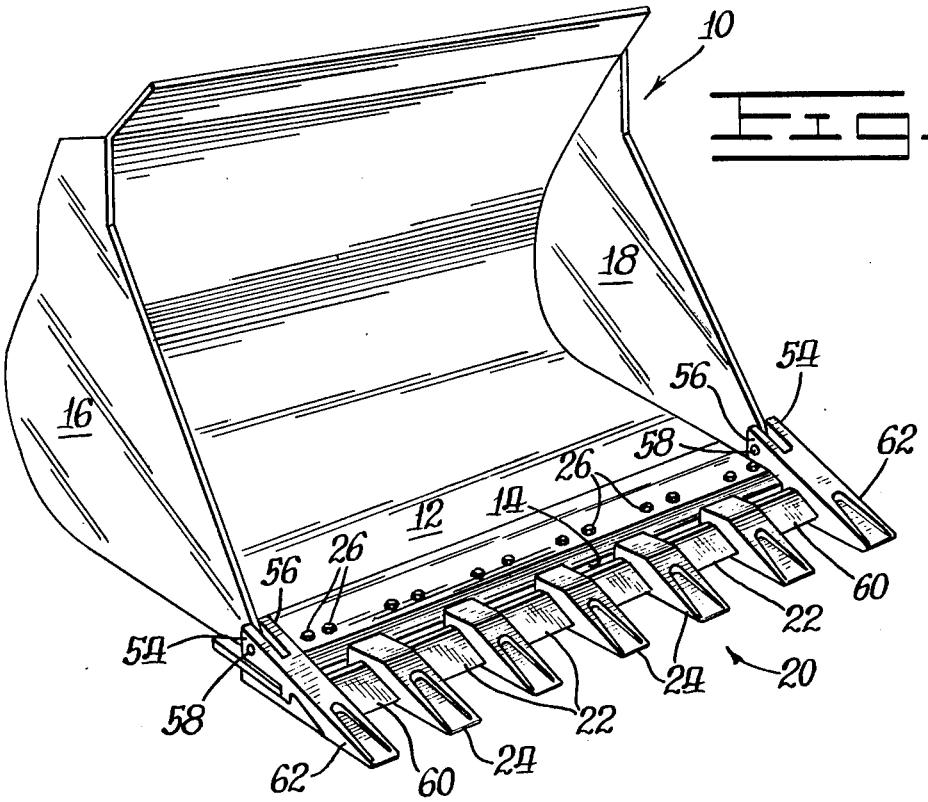
FIG. 1 is an isometric view of an earthmoving bucket with a replaceable cutting edge assembly constructed according to the present invention being arranged along a leading edge of the bucket.

The present invention is directed toward a replaceable cutting edge assembly for use upon earthmoving buckets of the type generally illustrated in FIG. 1. The implement illustrated in FIG. 1 is particularly adapted as a conventional bucket of the type employed on front end loaders. However, it will be obvious that the replaceable cutting edge assembly of the present invention may also be employed upon other earthmoving implements as well.

Referring particularly to FIG. 1, an earthmoving bucket of the type generally indicated at 10 includes a bucket floor 12 having a leading edge 14 (also see FIG. 3) with side walls indicated respectively at 16 and 18.

A cutting edge assembly constructed according to the present invention is generally indicated at 20. Specific construcional features of the replaceable cutting edge assembly 20 are set forth in greater detail below. However, the general configuration and operating advantages of the cutting edge assembly 20 may be best seen in FIG. 1. Initially, the cutting edge assembly 20 includes a plurality of cutting edge sections 22 with digging teeth 24 being arranged in spaced apart relation at the junctures between adjacent pairs of the cutting edge sections 22. One cutting edge section and one digging tooth adjacent each of the sidewalls 16 and 18 are specially configured for interconnecting cooperation of those elements.

In each of the embodiments of the present invention, it is particularly important to adapt the bucket for use either with the cutting edge sections 22 in combination with the digging teeth 24 or to adapt the bucket for use with a single elongated cutting edge of a type useful for finishing operations. In either instance, it is desirable to secure either the plurality of cutting edge sections 22 or the single elongated cutting edge (not shown) in place upon the leading edge of the bucket floor by means of the same bolts generally indicated at 26 in FIG. 1. The purpose for avoiding additional bolt holes is of course to minimize the occurrence of stress risers along the leading edge of the bucket floor.

Specific features of the cutting edge sections and digging teeth are set forth in greater detail below.

Figure 2:
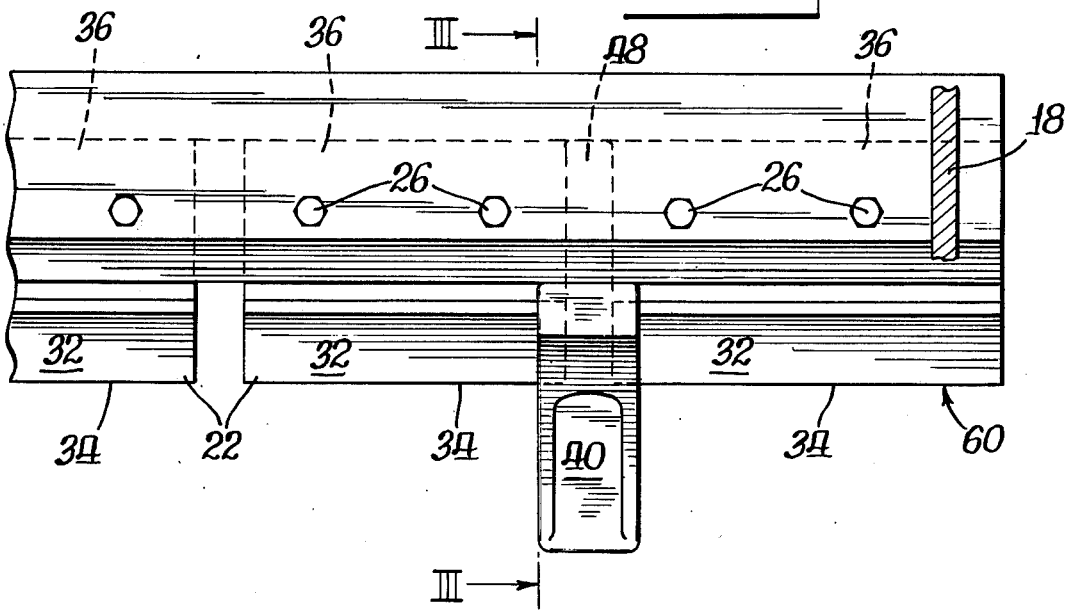
FIG. 2 is a fragmentary top view of a portion of the cutting edge assembly including a plurality of cutting edge sections, a digging tooth being omitted from the juncture between two of the cutting edge sections to better illustrate their construction.
Figure 3:
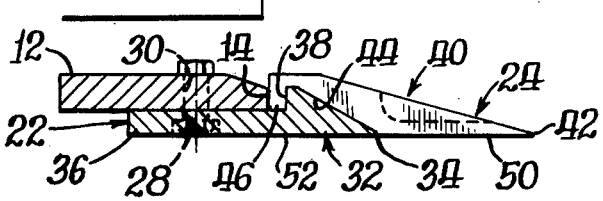
FIG. 3 is a view taken along sections line III—III in FIG. 2.

Referring particularly to FIGS. 2 and 3, it may be seen that the cutting edge sections 22 and the bucket floor 12 have aligned openings as indicated at 28 and 30 in FIG. 3 to receive the bolts 26 which secure the cutting edge sections in place along the leading edge of the bucket floor.

At the same time, the cutting edge sections 22 are configured to trap and maintain the digging teeth 24 in place in order to avoid the need for additional bolts to mount the digging teeth relative to either the bucket floor or the cutting edge sections. For this reason, the cutting edge sections 22, as best seen in FIG. 2, are slightly spaced apart at the juncture between each adjacent pair of cutting edge sections. Referring particularly to FIG. 3, each cutting edge section 22 includes a forwardly extending wedge shaped portion 32 which defines a cutting edge 34. Each cutting edge section also includes a flange 36 which extends rearwardly beneath the bucket floor and forms the opening 28 for receiving one of the bolts 26.

With the cutting edge section secured in place upon the bucket floor, a stepped surface 38 formed at the juncture between the wedge-shaped portion 32 and the flange 36 is spaced forwardly from the leading edge 14 of the bucket floor. This space provides a means for trapping and maintaining the digging teeth 24 in a manner described immediately below.

Figure 4:
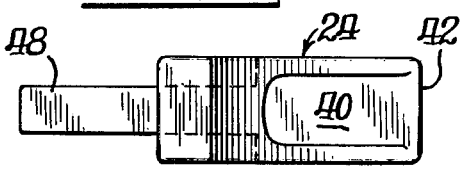
FIG. 4 is a top view of a single digging tooth employable within the replaceable cutting edge assembly of the present invention.

Referring now to FIGS. 2–4, as well as FIG. 1, each of the digging teeth 24 includes a generally wedge-shaped portion 40 also forming a forwardly extending cutting edge 42. A rearward portion of the wedge-shaped portion 40 defines a downwardly facing surface 44 arranged to overlap and conform with the surface of the wedge-shaped portion 32 for the adjacent cutting edge sections 22. The rearward portion of each tooth 24 behind the shaped surface 44 terminates in a vertically disposed tang 46 extending downwardly to fill the space between the cutting edge 14 and the stepped surface 38 on the cutting edges. The stepped surface 38 thus abuts the tang 46 and maintains it in abutting engagement with the leading edge 14 of the bucket floor as well.

Referring particularly to FIGS. 2 and 4, an alongated web 48 extends rearwardly from a bottom portion of each digging tooth in order to substantially fill the space between the spaced apart cutting edge sections beneath the bucket floor.

In this manner, each of the digging teeth is firmly held in place by the two adjacent cutting edge sections. In addition, as may be best seen in FIGS. 3, the bottom surface 50 of each digging tooth 24, beneath both its wedge-shaped portion 40 and its web 48, is arranged in flush alignment with the bottom surface 52 of each adjacent cutting edge section.

In most prior art configurations, at least a portion of each digging tooth extends beneath the bottom surface of the cutting edge. Thus, the digging teeth have normally provided a generally uneven configuration interfering with use of the bucket for finish operations.

With the present design, the bucket can be used for at least limited finishing operations, even with the digging teeth in place. However, as is apparent from FIG. 3, it is necessary to keep the bucket floor 12 generally parallel to the ground if finishing operations are to be accomplished with the digging teeth in place.

As may be best seen in FIGS. 1 and 2, one cutting edge section and one tooth adjacent each of the sidewalls 16 and 18 is configured to permit interconnection between those elements. As may be particularly seen in FIG. 2, one of the cutting edge sections, such as that indicated at 60 extends slightly outwardly past the respective sidewall, for example, that indicated at 18 in FIG. 2. An end cutting tooth, similarly indicated at 62, includes a pair of spaced apart, rearwardly extending flanges 54 and 56 for receiving the sidewall 18 therebetween. A common opening is formed through the flanges 54 and 56 as well as the respective sidewall in order to receive a bolt 58. Thus, the rearwardly extending flanges for each of the end digging teeth are secured to the sidewall while the outwardly extending portion of the end cutting edge section 60 provides a stepped surface as indicated at 38 in FIG. 3 for engagement with the tang 46 of the end cutting tooth 62.

The end digging tooth 62 and adjacent cutting edge section 60 at the other end of the cutting edge assembly are similarly configured for attachment to the sidewall 16.

Figure 5:
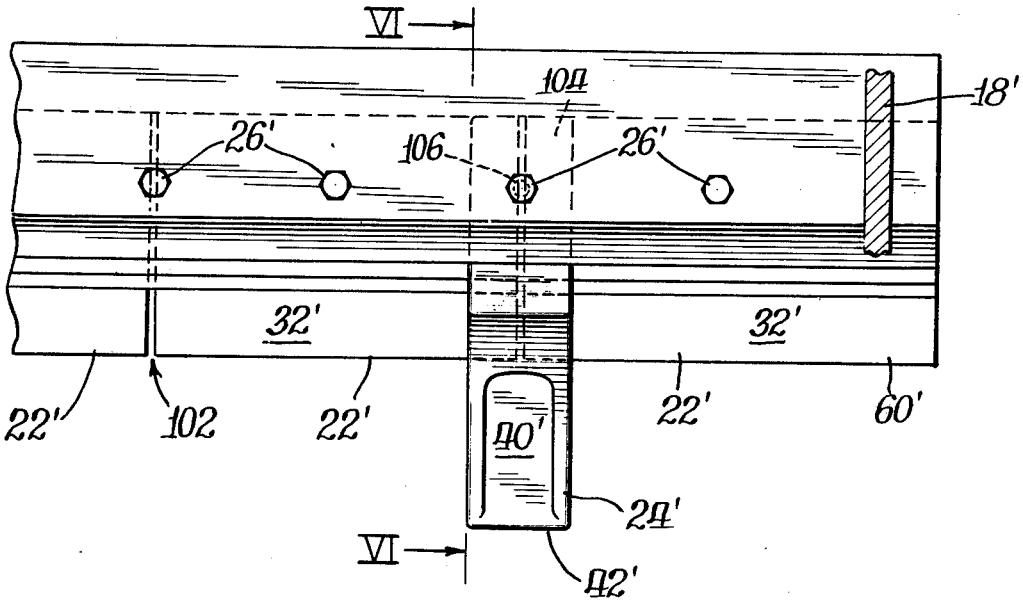
FIG. 5 is a view similar to FIG. 2 while illustrating another embodiment of the present invention.
Figure 6:
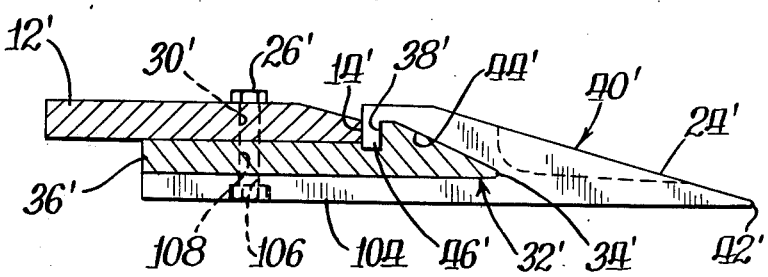
FIG. 6 is a view taken along section line VI—VI of FIG. 5.
Figure 7:
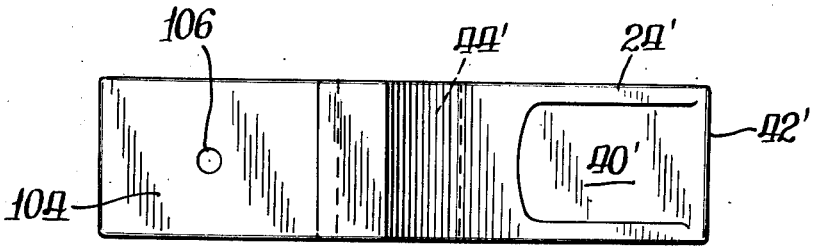
FIG. 7 is a top view of a digging tooth employable within the embodiment of FIG. 5.

The embodiment of FIGS. 5–7 is generally similar in many features to that described above with respect to the embodiment of FIGS. 1–4. Accordingly, similar elements of the embodiment of FIG. 5 are identified by primed numerals corresponding to those as set forth above. The embodiment of FIGS. 5–7 differs from the preceeding description primarily in that the adjacent cutting edge sections 22' extend substantially into abutting engagement with each other at their junctures as indicated at 102. Similarly, the digging teeth 24' do not include a rearwardly extending web of the type indicated at 48 in FIGS. 2 and 4. Rather, each of the digging teeth 24' includes a strap 104 which extends rearwardly beneath the bottom surface of the cutting edge sections to form an opening 106 in alignment with certain of the openings 30' in the bucket floor. In addition, the abutting end portions of the cutting edge sections 22' form in combination a similar opening 108 so that alternate ones of the bolts 26' (see FIG. 5) serve to secure the digging teeth 24' as well as the cutting edge sections 22'.

Within the embodiment of FIGS. 5–7, the adjacent cutting edge sections trap and maintain the digging teeth in place in the same manner as described above. The strap 104 provides additional means for securing the digging teeth in place. It may be seen, of course, from FIG. 6 that the bottom surface of the digging teeth 24' extends beneath the bottom surface of the cutting edge sections.

In either of the two embodiments described above, the plurality of cutting edge sections 22 or 22' may be replaced by a single elongated cutting edge while employing the same single row of bolt holes. The FIG. 5–7 embodiment provides additional attachment for maintaining the digging teeth in place while the FIG. 1–4 embodiment provides the flush bottom surface adapting the cutting edge assembly of that embodiment at least for finishing operations as well as digging operations.

I claim:

1. A replaceable cutting edge assembly for an earth-moving bucket having a floor, comprising:

a plurality of cutting edge sections arranged along a leading edge of the bucket floor, each cutting edge section including a wedge shaped portion extending forwardly from the leading edge of the bucket floor to define a cutting edge and a flange extending rearwardly from the wedge shaped portion to form a junction therewith, each said flange underlapping the bucket floor, the flange and the bucket floor defining holes alignable one with the other for receiving bolt means to secure the cutting edge section in place, each cutting edge section also including a rearwardly facing stepped surface at the junction between the wedge shaped portion and the flange, the stepped surface being spaced apart from the leading edge of the bucket floor to form a space therebetween and a digging tooth arranged at a juncture between each adjacent set of cutting edge sections, each digging tooth being formed with a generally wedge shaped tooth section extending forwardly of the wedge shaped portions of the cutting edge sections, a rearwardly extending overlapping portion of each tooth being configured to overlap the wedge shaped portions of the cutting edge sections with a vertically arranged, non-apertured tang extending downwardly from the rearwardly extending portion to fill the space between the leading edge of the bucket floor and the stepped surfaces of the two adjacent cutting edge sections, each digging tooth further including a rearwardly extending underlapping portion associated in an underlying relation with the bucket floor, said tang extending sufficiently downwardly to retain the tooth on the cutting edges, whereby the tang and the underlapping portion cooperate with adjacent cutting edges to retainably associate each tooth with the bucket.

2. The replaceable cutting edge assembly of claim 1 wherein the rearwardly extending underlapping portion of the digger tooth comprises a strap portion extending rearwardly from the tooth beneath both the adjacent cutting edge sections as well as the bucket floor, the tooth strap, the rearwardly extending flanges of the adjacent cutting edge sections and the bucket floor defining openings alignable for receiving bolt means to additionally secure the digging tooth in place.

3. The replaceable cutting edge assembly of claim 2 wherein the adjacent cutting edge sections are arranged in substantially abutting relation to define therebetween adjacent surfaces, the adjacent surfaces of the cutting edges forming an opening aligned with openings in the bucket floor and the rearwardly extending flange of the tooth section, and further comprising a bolt extending therethrough to secure both the tooth and the adjacent edge sections with respect to the bucket floor.

4. The replaceable cutting edge assembly of claim 1 wherein the adjacent cutting edge sections are spaced apart from each other to form an opening extending rearwardly beneath the bucket floor, the wedge shaped tooth portion of each digging tooth having a bottom surface arranged in alignment with a bottom surface of the adjacent cutting edge sections and including a rearwardly extending web element to substantially fill the opening between the adjacent cutting edge sections beneath the bucket floor.

5. The replaceable cutting edge assembly of claim 4 wherein the bucket includes perpendicularly extending sidewalls to each end of the floor, the sidewalls extending forwardly into general alignment with the leading edge of the bucket floor, one cutting edge section extending outwardly past each bucket sidewall, one end digging tooth being arranged generally in alignment with each bucket sidewall and having rearwardly extending flange portions to receive the respective sidewall therebetween.

6. The replaceable cutting edge assembly of claim 5 wherein the rearwardly extending flange portions of each end digging tooth and the respective side wall define openings alignable for receiving means to retain the end digging teeth in place relative to respective bucket side walls.

7. The replaceable cutting edge assembly of claim 1 wherein the bucket includes perpendicularly extending sidewalls at each end of the floor, the sidewalls extending forwardly into general alignment with the leading edge of the bucket floor, one cutting edge section extending outwardly past each bucket sidewall, one end digging tooth being arranged generally in alignment with each bucket sidewall and having rearwardly extending flange portions to receive the respective sidewall therebetween.

8. The replaceable cutting edge assembly of claim 7 wherein the rearwardly extending flange portions of each end digging tooth and the respective side wall define openings alignable for receiving means to retain the end digging teeth in place relative to the respective bucket side walls.

* * * * *

UNITED STATES PATENT OFFICE

CERTIFICATE OF CORRECTION

Patent No. 4,006,544 Dated February 8, 1977

Inventor(s) VISVALDIS A. STEPE

It is certified that error appears in the above-identified patent and that said Letters Patent are hereby corrected as shown below:

Column 6, line 25 change "to" to read --at--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*